US005855282A

United States Patent [19]

Hardy

[11] Patent Number: 5,855,282

[45] Date of Patent: Jan. 5, 1999

[54] PEG HOOK DISPLAY SYSTEM

[75] Inventor: Stephen N. Hardy, Wadsworth, Ohio

[73] Assignee: RTC Industries, Inc., Rolling Meadows, Ill.

[21] Appl. No.: 841,460

[22] Filed: Apr. 22, 1997

[51] Int. Cl.[6] ..... A47F 5/00

[52] U.S. Cl. ..... 211/59.1; 211/57.1; 211/88.01; 211/106

[58] Field of Search ..... 211/57.1, 59.1, 211/54.1, 59.2, 106, 88.01, 94.02, 49.1

[56] References Cited

U.S. PATENT DOCUMENTS

| | | | |
|---|---|---|---|
| 1,033,915 | 7/1912 | McDonald . | |
| 3,189,185 | 1/1962 | Grasso . | |
| 3,481,481 | 12/1969 | Wotel et al. . | |
| 3,501,015 | 3/1970 | Behles | 211/49.1 |
| 4,155,459 | 5/1979 | Manschak | 211/49.1 |
| 4,289,242 | 9/1981 | Kenyon . | |
| 4,310,097 | 1/1982 | Merl . | |
| 4,557,456 | 12/1985 | Mueller . | |
| 4,632,256 | 12/1986 | Gambello . | |
| 4,742,923 | 5/1988 | Calvert | 211/57.1 |
| 4,905,846 | 3/1990 | Calvert . | |
| 5,009,334 | 4/1991 | Bodkins . | |
| 5,322,175 | 6/1994 | Nobili . | |
| 5,388,709 | 2/1995 | Adams . | |
| 5,425,461 | 6/1995 | Larson | 211/59.1 X |
| 5,706,956 | 1/1998 | Headrick et al. | 211/74 X |

FOREIGN PATENT DOCUMENTS

| | | |
|---|---|---|
| 640139 | 3/1964 | Belgium . |
| 801003 | 12/1950 | Germany . |

*Primary Examiner*—Robert W. Gibson, Jr.
*Attorney, Agent, or Firm*—Banner & Witcoff Ltd.

[57] ABSTRACT

A gravity fed display device for displaying hangable articles comprising a mounting board, including a display surface, a suspension apparatus downwardly extending from the mounting board, and a guide apparatus extending substantially parallel to the suspension apparatus. The hangable articles are suspended from the suspension apparatus and the hangable articles rest against the guide apparatus so that they hang parallel to one another. The mounting board may be a peg board and the suspension apparatus may be a peg hook. The suspension apparatus may include an upwardly extending portion and the guide apparatus may include an upwardly extending portion.

13 Claims, 4 Drawing Sheets

PEG HOOK DISPLAY SYSTEM

FIELD OF INVENTION

The present invention relates to a display apparatus and more particularly to a gravity fed pegboard and peg hook display system.

BACKGROUND OF THE INVENTION

Display systems for pegboards are well known and typically include a metal peg hook inserted into a pegboard. Multiple hangable articles, such as cardboard blister packages, hang from the peg hook.

Often the peg hook extends downwardly from the peg board so that as one hangable article is removed from an end of the peg hook, the remaining hangable articles slide down the peg hook toward the end. In other words, the force of gravity causes the hangable articles to be fed along the peg hook. Thus, once a consumer removes a hangable article from the end of the peg hook, the remaining hangable articles slide along the peg hook, and another hangable article is thus displayed at the end of the peg hook. In order to prevent the hangable articles from sliding off the end of the downwardly extending peg hook, the peg hook is typically angled upward at the end, resulting in a bend in the peg hook.

As a result of gravity, the hangable articles press against each other along the peg hook. Often the hangable articles are irregularly shaped, bulky or are thinner at the top of the article. As a result, the hangable articles will fan forward and backward and bunch together as they rest against each other near the bend of the peg hook. The resulting appearance of the hangable articles is disorderly, which is undesirable, for example, in a retail store location.

It is therefore an object of the present invention to provide a novel gravity feed combined display and storage unit. It is a further object of the present invention to provide a gravity feed system with a guide so that the hangable articles hang parallel to one another from a peg hook.

SUMMARY OF THE INVENTION

In principal aspect, the present invention is a gravity fed display device for displaying hangable articles comprising a mounting board such as a peg board, a suspension apparatus, such as a peg hook, downwardly extending from the mounting board, and a guide apparatus extending substantially parallel to the suspension apparatus. The hangable articles are suspended from the suspension apparatus and rest against the guide apparatus so that they hang parallel to one another.

The suspension apparatus may also include an upwardly extending portion and the guide apparatus may include an upwardly extending portion.

In another embodiment, the display device may also be connected to the guide apparatus and a mounting apparatus may comprise a plurality of openings for receiving the suspension apparatus. In another embodiment of the invention, the guide apparatus may also comprise a first rail and a second rail, the first rail and the second rail independently affixable to the mounting board.

BRIEF DESCRIPTION OF THE DRAWINGS

Preferred embodiments of the present invention are described with reference to the following drawings where.

DETAILED DESCRIPTION OF THE EMBODIMENT

Figure 2:
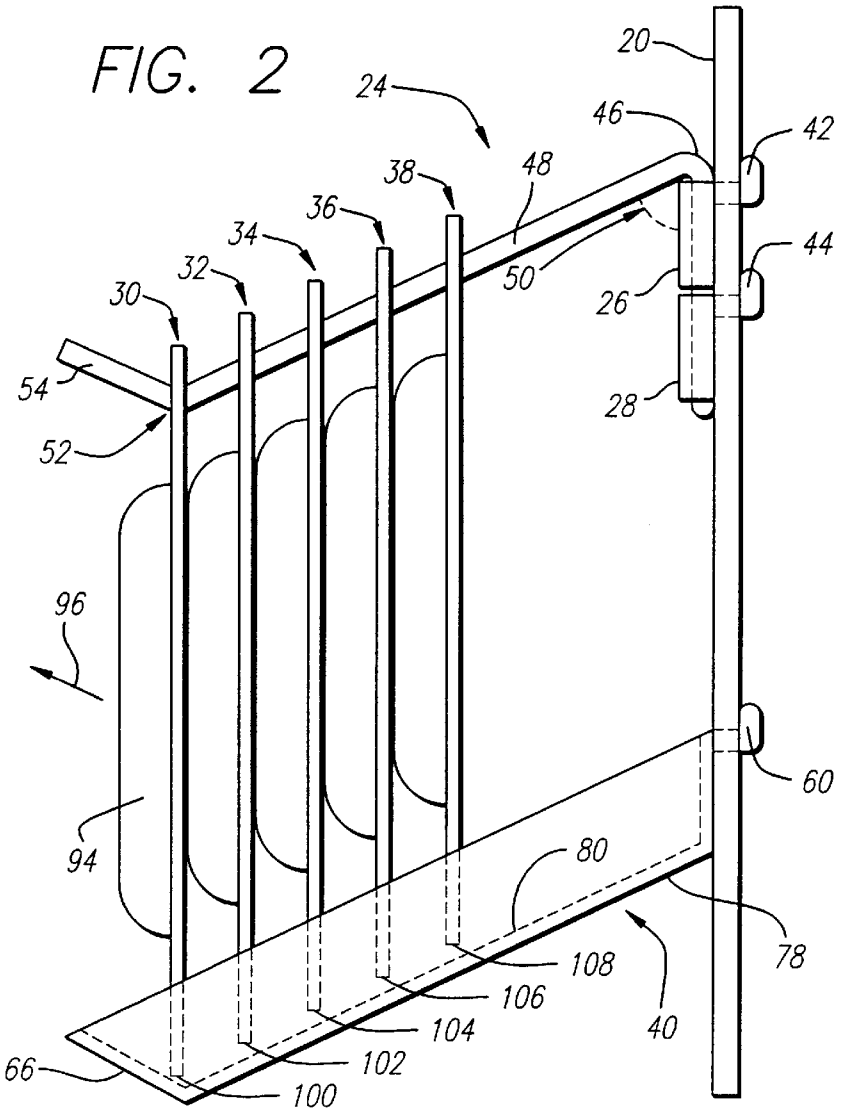
FIG. 2 is a side elevational view of the preferred embodiment shown in FIG. 1.
Figure 1:
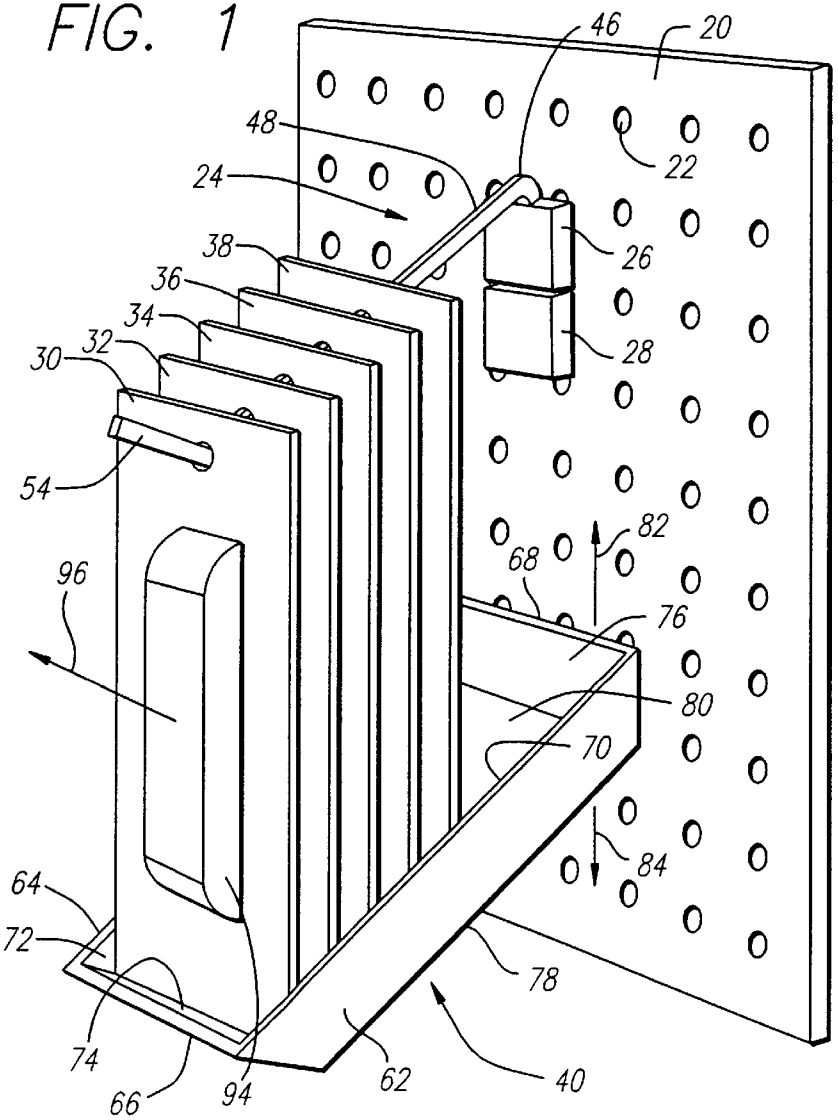
FIG. 1 is a side perspective view of the preferred embodiment of the invention.

As illustrated in FIG. 1 and FIG. 2, a preferred embodiment of the invention includes a mounting board 20 with a plurality of apertures or openings, for example, as shown at 22 in FIG. 1. An arm, also referred to as a suspension apparatus 24, is affixed to and extends outwardly from the mounting board 20. The mounting board 20 is preferably a peg board or peg wall, and the arm 24 is preferably a peg hook. A fastening apparatus 26 and a fastening apparatus 28 connect the peg hook 24 to the peg board 20. Hangable articles 30, 32, 34, 36 and 38, such as blister card packages hang from the peg hook 24. A guide apparatus or guide tray 40 is also connected to the mounting or peg board 20. The hangable articles 30, 32, 34 and 36 and 38 rest against the guide tray 40.

As shown in FIG. 2, the peg hook 24 includes hook 42 and a hook 44 that connect the peg hook 24 to the peg wall 20. The peg hook 24 further includes a curved portion 46 and a downwardly extending portion 48 that extends outwardly from the mounting board at an acute angle, as shown by the arrow 50 in FIG. 2. In a preferred embodiment, this angle is 65°. The peg hook 24 further includes a curved portion 52 and an upwardly extending portion 54.

The guide tray 40 includes a hook 60, as seen in FIG. 2 that connects the guide 40 to the peg board 20. The guide tray 40 may also be affixed to the peg board 20 by a plurality of hooks (not shown). Referring to FIG. 1, the guide 40 also includes side outer edges 62 and 64, as well as a front outer edge 66 and a rear outer edge 68 that rest against the peg board 20. Similarly, the guide tray 40 includes an inner side edge 70, an inner side edge 72, an inner front edge 74 and an inner rear edge 76. As shown in FIG. 2, the guide 40 further includes an outer bottom edge 78 and an inner bottom edge 80.

Figure 3:
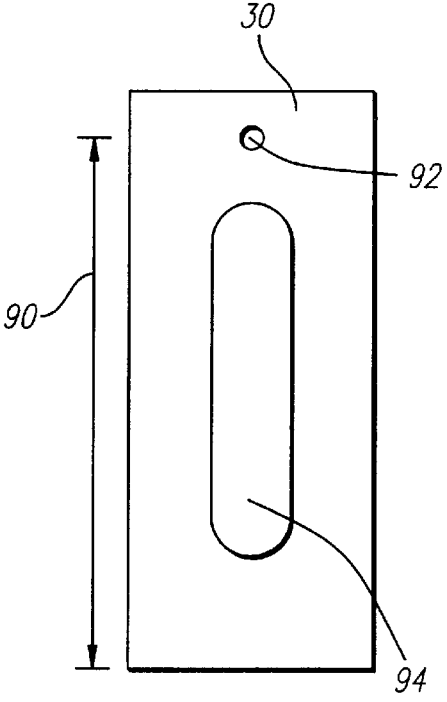
FIG. 3 is a front elevational view of a blister card used in the invention.

As is indicated by the arrows 82 and 84 in FIG. 1, the guide tray 40 can be affixed at a higher or lower vertical level on the pegboard 20. The distance between the peg hook 24 and the inner bottom edge 80 of the guide tray 40 depends on the vertical height of the blister package 30, as indicated by the arrow 90 in FIG. 3. Further referring to FIG. 3, the blister package 30 includes an opening or aperture 92 along which the blister package 30 slides on the peg hook 24.

The blister package 30 typically houses a consumer item 94. Referring to FIG. 1 and FIG. 2, the consumer item 94 extends from the blister package 30. The consumer item 94 is thus available for viewing by a consumer, who can remove the blister package 30 from the peg hook 24 by pulling the blister package 30 in the direction indicated by the arrow 96. Once the blister package 30 is removed from the peg board 24, the remaining blister packages 32, 34, 36 and 38 slide along the peg hook 24 until the blister package 32 comes to rest at the bend 52 in the peg hook 24.

As seen in FIG. 2, the blister packages 30, 32, 34, 36 and 38 rest against one another as they hang along the peg hook 24. In addition, each of the blister packages 30, 32, 34, 36 and 38 include a bottom edge 100, 102, 104, 106 and 108, respectively, that rests against the inner bottom edge 80 of the guide tray 40. The guide tray 40 thus causes the blister packages 30, 32, 34, 36 and 38 to hang vertically and parallel to each other. The side outer edges 62 and 64 also serve to prevent the blister packages 30, 32, 34, 36 and 38 from swinging side to side or rotating about the peg hook 24, further enhancing the orderly appearance of the blister packages.

Figure 4:
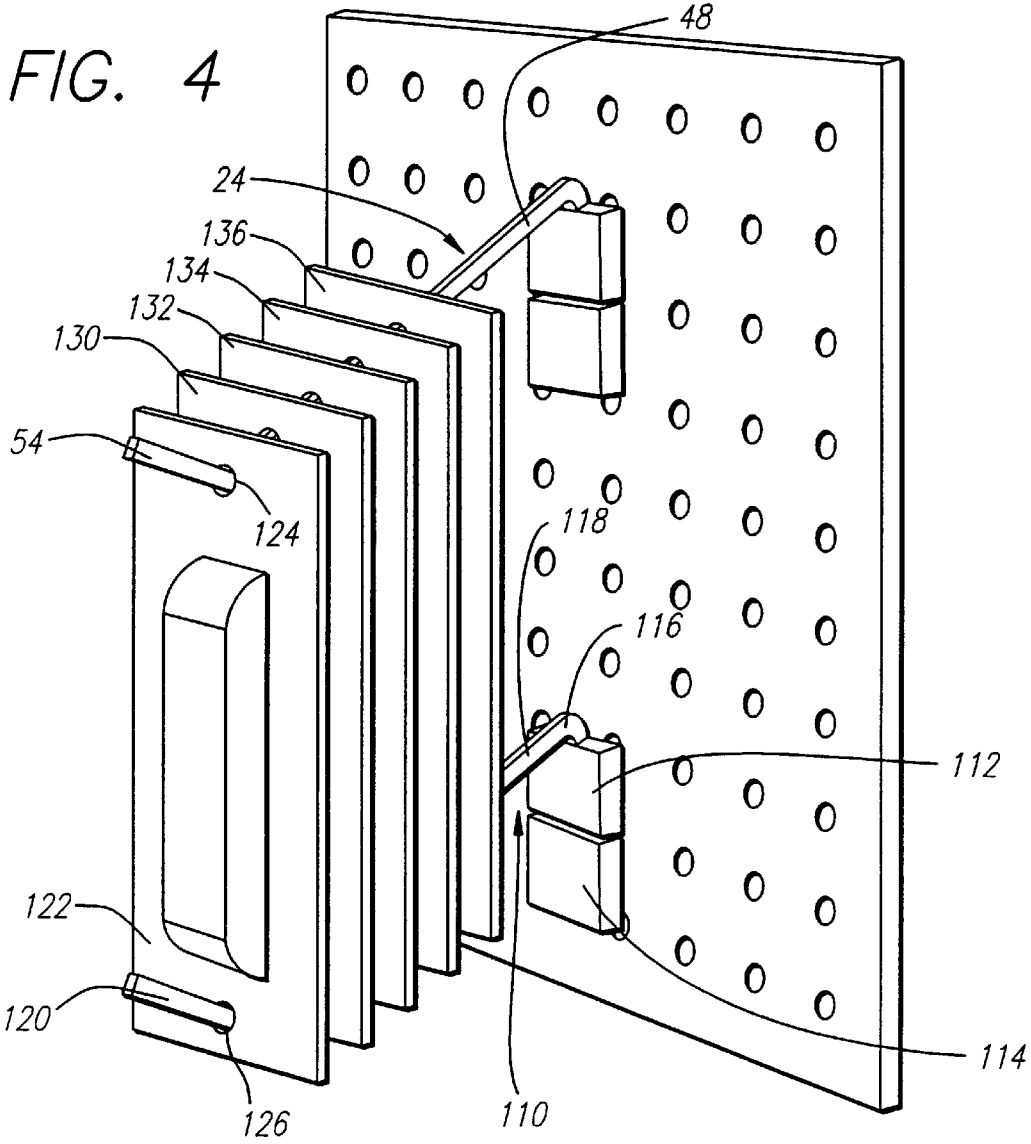
FIG. 4 is a side perspective of an alternative preferred embodiment of the invention.

FIG. 4 shows an alternative preferred embodiment where a peg hook 110 serves as a guide for the blister packages. The peg hook 110 is affixed to the peg board 20 by a fastening apparatus 112 and 114, and includes a curved portion 116, a downwardly extending portion 118 and an upwardly extending portion 120. Between the portion 118 and the portion 120 is a curved portion (not shown). The portion 118 and the portion 120 are parallel to the portion 48 and portion 54 in the peg hook 24, respectively. A blister package 122 hangs from the peg hook 24 by an opening or aperture 124 and also hangs from the peg hook 110 by an opening or aperture 126. As in FIG. 1, blister packages 122, 130, 132, 134 and 136 hang vertically from the peg hook 24 parallel to each other.

Figure 5:
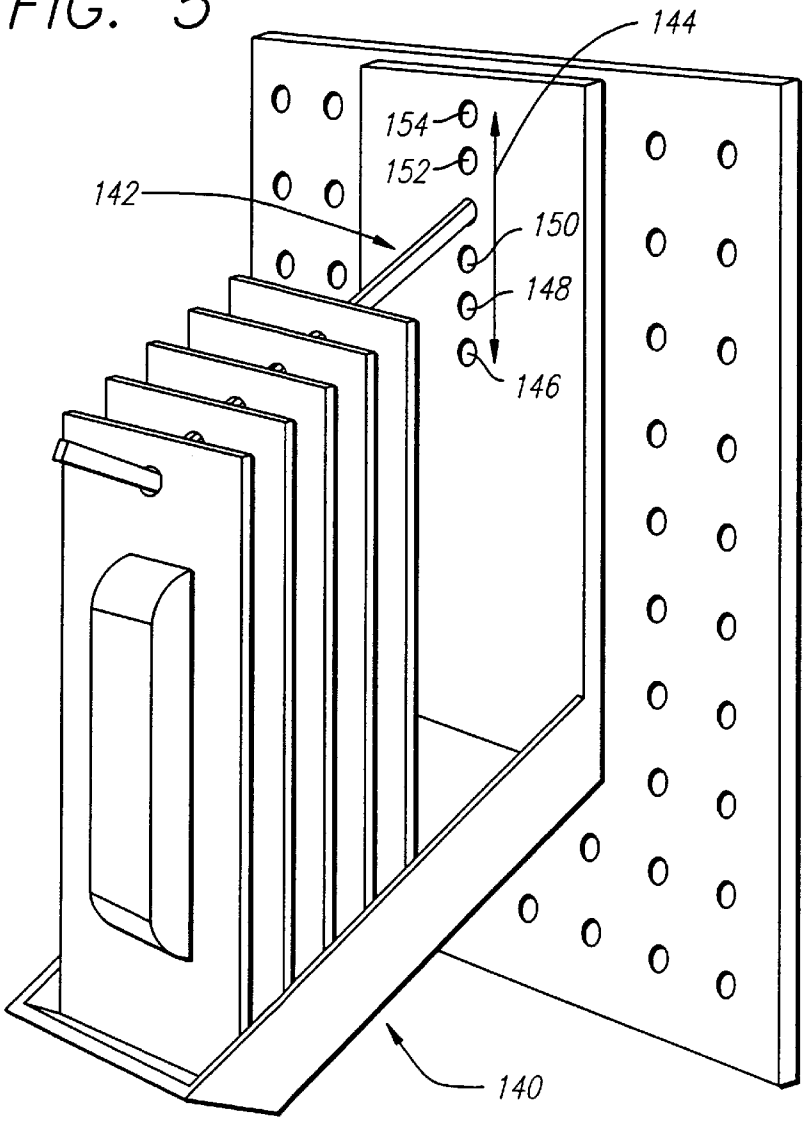
FIG. 5 is a side perspective view of an alternative preferred embodiment of the invention.

As shown in FIG. 5, in an alternative preferred embodiment, the system includes guide unit 140 that consists of a single piece of material to which a peg hook 142 is attached. As indicated by the arrow 144, the peg hook 142 may be affixed to the guide unit 140 at any of the apertures or openings 146, 148, 150, 152 or 154.

Figure 6:
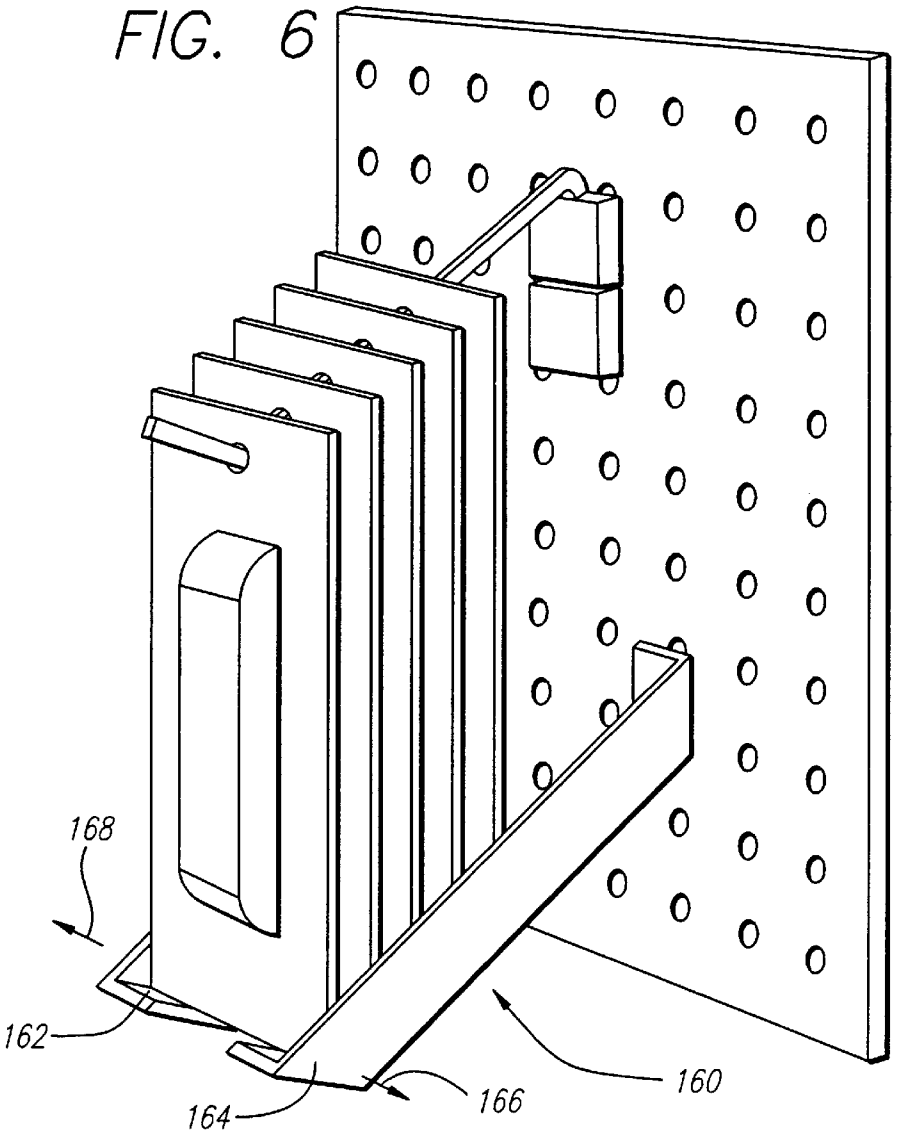
FIG. 6 is a side perspective view of an alternative preferred embodiment of the invention.

Another alternative preferred embodiment is shown in FIG. 6, where a guide 160 includes a first rail 162 and a second rail 164. The rails 162 and 164 are independently connected to the peg board 20, so that the dimension of the guide 160 may be adjusted, as indicated by the arrows 166 and 168, to accommodate different size hangable articles.

Figure 7:
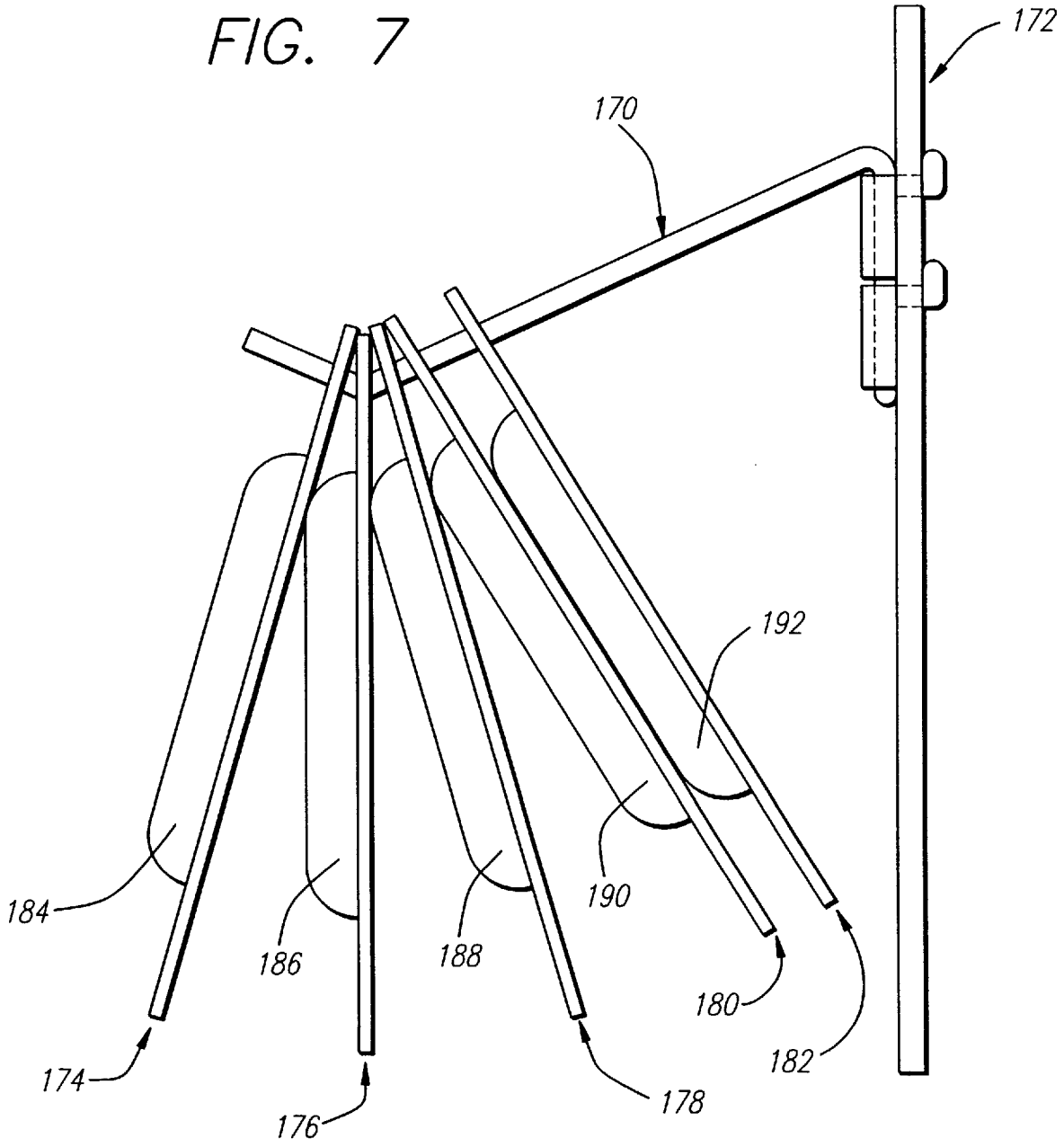
FIG. 7 is a side elevational view of a prior art gravity feed system.

Problems associated with other gravity feed systems are illustrated in FIG. 7. A peg hook 170 extends downwardly from a peg wall 172. Blister card packages 174, 176, 178, 180 and 182 hang from the peg hook 170. Thus, gravity feeds the blister card packages 174, 176, 180 and 182 along the angled peg hook 170. As the blister package 174 is removed from the peg hook 170, the remaining blister card packages 176, 178, 180 and 182 slide along the peg hook 170, allowing the consumer access to the next blister package. However, due to protrusions of the items on the blister package, shown at 184, 186, 188, 190 and 192, as well as gravity forces and counter forces, the blister packages 174, 176, 178, 180 and 182 fan out and bunch together. Thus, the display has a disordered and undesirable appearance.

It is to be understood that alternative forms of the various components of the described embodiments are covered by the full scope of the claimed invention and its equivalents. To particularly point out and distinctly claim the subjects regarded as the invention, the following claims conclude this specification.

What is claimed is:

1. A gravity fed display device for displaying hangable articles comprising:

a mounting board;

a suspension apparatus downwardly extending from the mounting board, the suspension apparatus being adapted to engage a first hole near the top of the hangable article; and a guide apparatus beneath the suspension apparatus extending substantially parallel to the suspension apparatus, the guide apparatus being adapted to engage a second hole near the bottom of the hangable article, whereby the hangable articles displayed on the gravity fed display device hang parallel to each other both transversely and longitudinally relative to the suspension apparatus and the guide apparatus.

2. The display device as in claim 1 wherein the mounting board is a board having at least one hole and the suspension apparatus is a peg hook.

3. The display device as in claim 2 wherein the guide apparatus is a peg hook.

4. The display device as in claim 1 wherein the suspension apparatus includes an upwardly extending portion and the guide apparatus includes an upwardly extending portion.

5. The display device as in claim 3 wherein the suspension apparatus includes an upwardly extending portion and the guide apparatus includes an upwardly extending portion.

6. The display device as in claim 1 wherein the suspension apparatus is connected to the guide apparatus.

7. The display device as in claim 6 further comprising a mounting apparatus comprising a plurality of openings for receiving the suspension apparatus.

8. A gravity fed display device for storing a first and a second product comprising:

a board;

an arm extending from the board, the arm including a first portion, a bend and a second portion, the first portion of the arm affixed at one end to the board and extending downwardly from the board, the second portion of the arm extending upwardly from the board, the arm being adapted to engage a hole near the top of the first product and a hole near the top of the second product;

a guide extending from the board beneath the arm, the guide including a first portion, a bend and a second portion, the first portion of the guide affixed at one end to the board and extending downwardly from the board substantially parallel to the first portion of the arm, the second portion of the guide extending upwardly from the board substantially parallel to the second portion of the arm, the guide having a bottom edge positioned such that it engages a bottom edge of the first product and a bottom edge of the second product, whereby the first product and the second product hang parallel to each other both transversely and longitudinally relative to the arm.

9. The display device as in claim 8 wherein the arm is a peg hook.

10. The display device as in claim 8 wherein the arm is connected to the guide.

11. The display device as in claim 8 further comprising a mounting apparatus comprising a plurality of openings for receiving the arm.

12. The display device as in claim 8 wherein the guide comprises a first rail and a second rail, the first rail and the second rail independently affixable to the display surface.

13. A guided gravity hook system for parallel display of a plurality of hanging items, comprising:

a board having at least one hole;

a peg hook connected to the board, the peg hook extending outwardly and sloping downwardly from the board and being adapted to engage holes near the tops of the plurality of hanging items; and a guide tray having a bottom edge, the guide tray being connected to the board, the guide tray extending outwardly and sloping downwardly from the mounting peg board, the guide tray being positioned beneath and substantially parallel to the peg hook such that bottom edges of the hanging items rest against the bottom edge of the guide tray, whereby the hanging items hang parallel to each other both transversely and longitudinally relative to the peg hook.

* * * * *